US005528862A

United States Patent [19]

Streeter

[11] Patent Number: 5,528,862

[45] Date of Patent: Jun. 25, 1996

[54] GATE ROLLER ASSEMBLY GUARD

[75] Inventor: Steven J. Streeter, Parker, Colo.

[73] Assignee: Guidance Systems, Inc., Parker, Colo.

[21] Appl. No.: 377,204

[22] Filed: Jan. 24, 1995

[51] Int. Cl.[6] ..... E05D 15/06

[52] U.S. Cl. ..... 49/404

[58] Field of Search ..... 49/404, 425, 426, 49/427, 460, 409, 410, 411; 16/86.1, 91, 95 R, 96 R

[56] References Cited

U.S. PATENT DOCUMENTS

| | | | |
|---|---|---|---|
| 771,766 | 10/1904 | Burkholder . | |
| 1,193,171 | 8/1916 | Mathews . | |
| 1,356,005 | 10/1920 | O'Connor . | |
| 3,106,000 | 10/1963 | Beauchamp | 20/23 |
| 3,613,314 | 10/1971 | Ford | 49/425 |
| 3,619,947 | 11/1971 | Burum | 49/425 |
| 3,861,084 | 1/1975 | Ford | 49/427 |
| 4,109,847 | 8/1978 | Bailey | 228/119 |
| 4,628,638 | 12/1986 | Elko et al. | 49/426 |
| 4,723,374 | 2/1988 | Peterson et al. | 49/404 |
| 5,022,185 | 6/1991 | Oatman | 49/425 |
| 5,136,813 | 8/1992 | Gibbs et al. | 49/426 X |
| 5,272,838 | 12/1993 | Gibbs | 49/426 X |

*Primary Examiner*—Jerry Redman
*Attorney, Agent, or Firm*—John E. Reilly

[57] ABSTRACT

A unitary protective roller cover adapted for use in a sliding gate system which includes a horizontally disposed gate having an upper horizontal gate support rod guided by at least one grooved roller rotatably mounted on a stub shaft in a mounting bracket clamped to a vertical support post. The unitary protective cover includes a roller enclosure portion having an open bottom and an integral stub shaft and mounting bracket enclosure portion having an open bottom. The bracket cover portion has a pair of spaced vertical side walls merging with a top portion covering the stub shaft and a portion of the mounting bracket. The stub shaft enclosure portion merges with the roller enclosure portion to form an open bottom unitary structure whereby the roller, stub shaft and a substantial portion of the mounting bracket are environmentally protected and entry of fingers and clothing beneath the roller is precluded.

12 Claims, 2 Drawing Sheets

GATE ROLLER ASSEMBLY GUARD

BACKGROUND AND FIELD OF INVENTION

This invention generally relates to safety and protective devices; and more particularly relates to a protective roller cover for a cantilever supported roller support in a horizontal industrial type sliding gate system.

Large sliding gates of chain link fencing are often used across road entrances, such as, estates and industrial complexes. These gates are usually made in long rectangular panels of fencing stretched on tubular metal frames which are often remotely moved horizontally across the roadway or gate opening. The tubular frame itself or horizontal guide rods mounted ont he gate frame ride on grooved rollers which are typically cantilever supported from vertical support posts embedded in the ground adjacent the gate opening. Usually two spaced posts, each having a vertically spaced set of two rollers, are used to sandwich and support each gate section. For extra wide gate sections, a ground roller may also be used to support a portion of the gate from the ground as it traverses the roadway. Typical roller supports for doors and gages are generally disclosed in U.S. Pat. Nos. 771,766, 1,193,171, 1,356,005, 3,106,000, 3,613,314, 3,619,947, 3,861,084, 4,109,847, 4,628,638 and 4,723,374.

The rollers of the large, heavy gate assemblies particularly pose a potential personnel hazard. There have been instances in which minor accidents have occurred, such as, where a person would catch a finger or shirt sleeve in one of the rollers supporting the gate as the gate is actuated. Accordingly, a safety guard such as is disclosed in U.S. Pat. No. 5,022,185 to Oatman was developed specifically to address this problem. However, the Oatman guard suffers from at least two distinct disadvantages. First, it is bolted to the support post that it is difficult to remove in order to perform roller maintenance. Second, it does not cover the cantilever support for the roller so that fingers as well as rain and snow can easily get into the space between the roller bearings and the stub shaft supporting the bearings and roller with detrimental operating results as well as posing a serious potential for injury. Accordingly, there is a need for a roller guard cover which avoids these disadvantages.

SUMMARY OF THE INVENTION

It is therefore an object of the present invention to provide a novel and improved cover for a cantilever supported gate roller which substantially covers the roller, stub shaft and cantilever support bracket.

It is another object of the invention to provide an improved roller cover which can readily and conveniently be removed without tools for maintenance of the roller.

It is a still further object of the invention to provide an improved gate roller of a material having improved operational characteristics and extended service life.

It is a still further object of the invention to provide an improved roller cover which vertically slides over the roller and mounting bracket.

It is a still further object of the invention to provide an improved roller cover which rests directly on the support bracket and the sliding gate bar.

It is a still further object of the invention to provide a cover which cannot be horizontally removed from the roller.

It is a still further object to provide a simple, one-piece molded gate roller assembly cover which is economical to manufacture and use.

In particular the improved roller guard cover in accordance with the present invention is designed for use in a sliding gate system which includes a horizontally disposed gate having an upper horizontal gate support rod or bar guided by at least one grooved roller. The roller is rotatably mounted on a stub shaft secured to a vertical support post by a mounting bracket, typically clamped to the support post with U bolts. The protective cover in accordance with the present invention includes an integral roller cover portion and a stub shaft and bracket cover portion each having an open bottom. The stub shaft and mounting bracket cover portion is generally box-shaped with a pair of spaced vertical side walls merging into a horizontal top portion covering the mounting bracket and the stub shaft. The stub shaft enclosure portion has an open back side and merges with the roller cover portion. These two portions form an open bottom unitary structure over and around both the roller and the mounting bracket. This arrangement is easily lifted off of the roller assembly and yet provides substantial protection against entry of fingers, etc. as well as providing protection from the sun and entry of rain and snow which are detrimental to roller operation.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Turning now to the drawings, FIGS. 1–5 show various views of an upper gate roller assembly 10 cantilever supported from a vertical support post 12. The roller assembly 10 guides passage of an externally driven gate support bar or frame member 14 horizontally past the support post 12.

Figure 5:
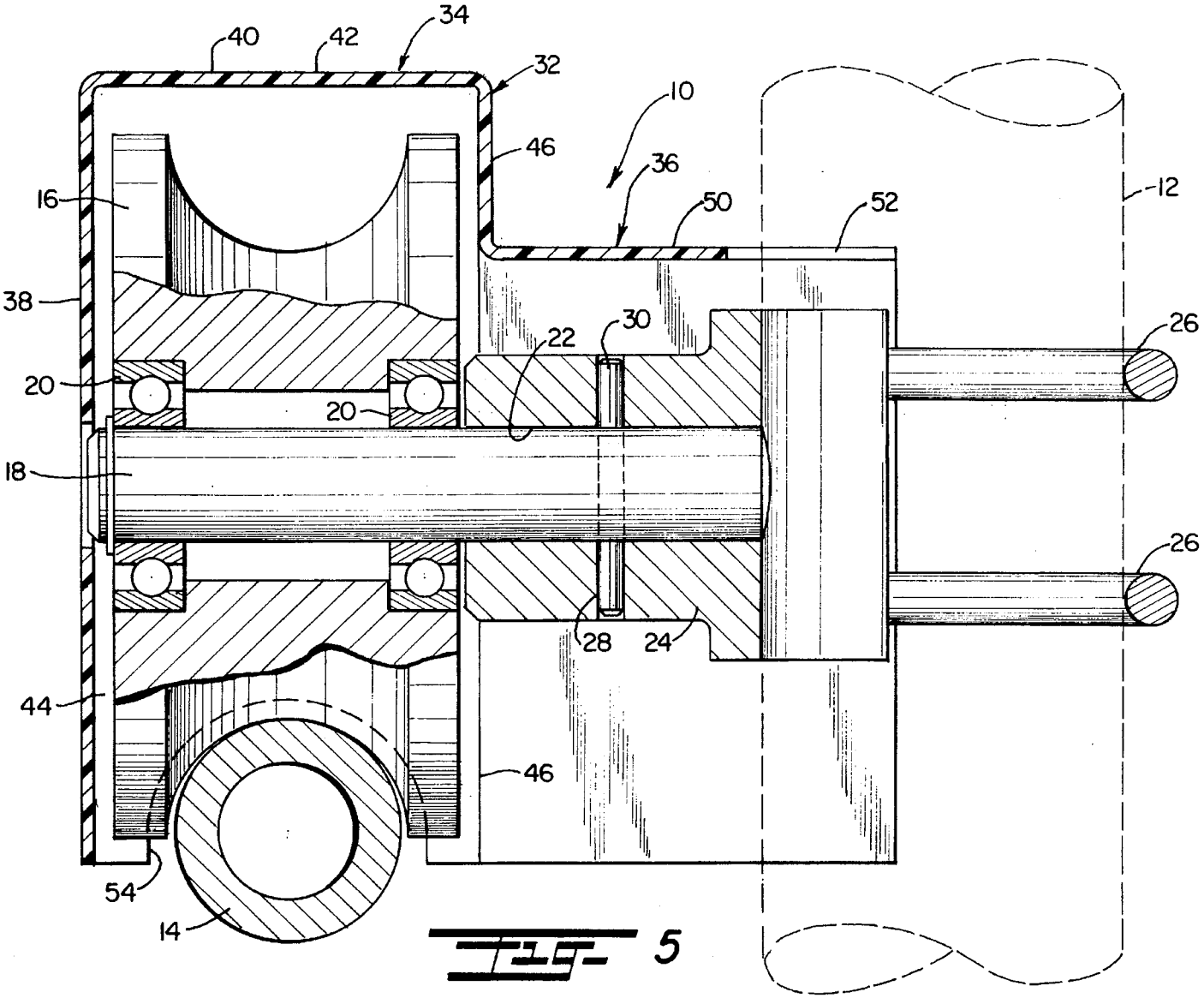
FIG. 5 is a sectional view through the assembly shown in FIG. 1 taken along line 5—5 of FIG. 3.

The roller assembly 10 comprises a grooved roller 16 made of plastic, rubber or metal which is rotatably supported on a horizontal stub shaft 18 via a pair of bearings 20. The stub shaft 18 is in turn fixed in a horizontal bore 22 through a mounting bracket 24. The mounting bracket 24 is clamped to the gate support post 12 with a pair of spaced "U" bolts 26. The mounting bracket 24 has a cross bore 28 frictionally receiving a roller pin 30 which also passes through the stub shaft 18 to secure the stub shaft 18 in place as shown in FIG. 5. Finally, the roller 16 is retained on the stub shaft 18 by a retaining ring 31.

The roller assembly 10, including the mounting bracket 24 and stub shaft 18, are protectively housed in a roller guard cover 32 having an open bottom which vertically slides over the roller assembly 10 comprising the roller 16 and the mounting bracket 24. The cover 32 comprises a larger roller cover portion 34 and an integral smaller bracket cover portion 36. The roller cover portion 34 has a vertical end wall 38 substantially covering the end face of the roller 16 and a peripheral shroud or wall 40 of inverted, generally U-shaped configuration over the greater periphery of the roller 16. The wall 40 has a semicircular portion 42 over the upper half of the roller 16 and a pair of spaced parallel vertical side wall portions 44 form downward continuations of the portion 42 on either side of the roller 16 above the gate bar 14. Spaced from the end wall 38 is an intermediate vertical wall 46 which joins together the vertical side wall portions 44 and the semicircular portion 42 of the peripheral wall 40 with the bracket cover portion 36 described in more detail below.

The stub shaft and mounting bracket cover portion 36 is of generally rectangular or box-shape configuration with an open bottom and back side. The mounting bracket cover portion 36 comprises a pair of spaced vertical side walls 48 which are parallel to and spaced inwardly of the vertical side wall portions 44 of the peripheral wall 40 of the roller cover portion 34. The vertical side wall portions 48 merge at the top in a horizontal, flat top wall 50 across the top of the mounting bracket 24. The vertical walls 48 and top wall 50 merge with the intermediate vertical wall 46 of the roller cover portion 34. As best seen from FIG. 3, the top wall 50 has an arcuate cutout or recess 52 formed in its rear edge and shaped to receive a portion of the support post 12 so that the bracket cover portion 36 partially wraps around the support post 12 to cover substantially all of the bracket 24. In this manner, the bracket cover portion 36 encloses the threaded portions and the nuts on the U bolts 26.

Each of the vertical side wall portions 44 of the peripheral wall 40 of the roller cover portion 34 has a semicircular cutout 54 in its bottom edge so that the roller cover portion 34 fits down over the upper half of the gate support rod or bar 14 to preclude entry under the cover 32 of fingers or errant portions of clothing. The cover 32 in accordance with the invention is designed to be slipped vertically over the roller assembly and simply lightly supported by the bracket 24 and roller 16. However, for more secure installation, each vertical side wall 48 of the bracket cover portion 36 has an aperture 56 therethrough. A wire or rod, such as, a coat hanger wire is passed beneath the bracket 24, through the apertures 56 and bent over alongside the vertical walls 48 to secure the cover 32 loosely in place.

The roller cover portion 34 is sized slightly larger and wider than the roller 16 so that the roller 16 easily fits within the enclosure defined by the end wall 38, the peripheral wall 40, and the intermediate vertical wall 46 with about a one-quarter to one-half inch gap between the inner surface of the roller cover portion 34 and the roller 16.

Figure 3:
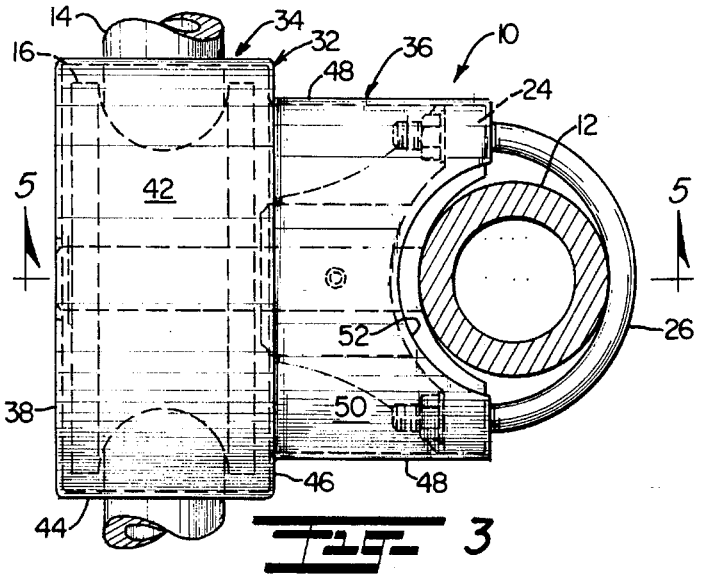
FIG. 3 is a top view partially in section of the roller assembly and guard cover shown in Figure.
Figure 1:
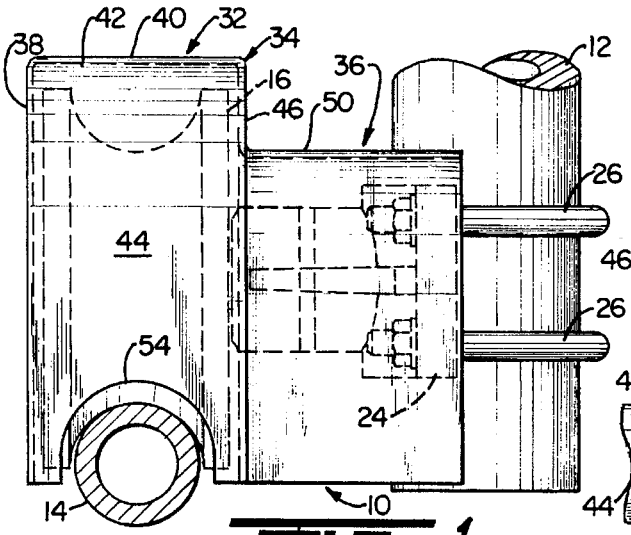
FIG. 1 is a side view of a gate roller assembly installed on a gate post with a guard cover in accordance with the invention.
Figure 2:
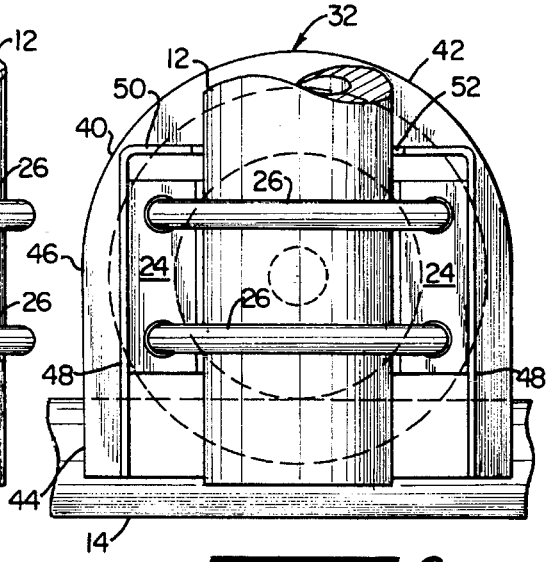
FIG. 2 is a front view of the roller assembly and guard cover shown in FIG. 1.
Figure 4:
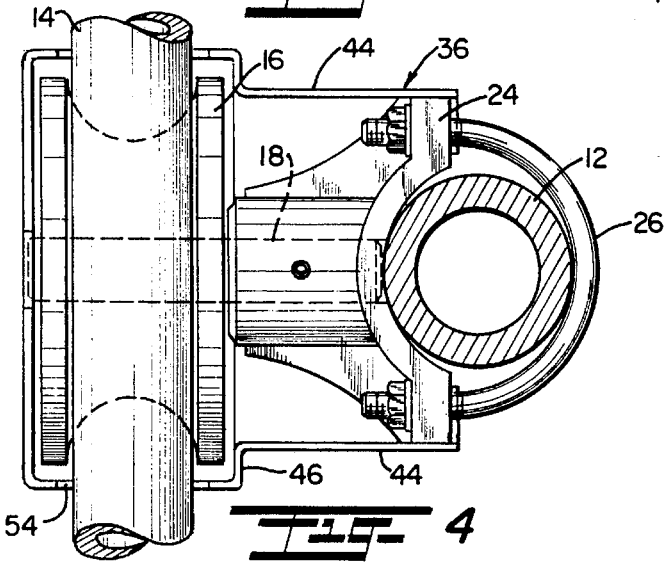
FIG. 4 is a bottom plan view of the roller assembly and guard cover shown in FIG. 3 from beneath the assembly.

The mounting bracket cover portion 36 is sized so that the vertical side walls 48 frictionally engage the outer sides of the base of the mounting bracket 24 as best seen in FIG. 2. This is preferably accomplished by dimensioning the top wall 50 to be the same as the width of the bracket 24.

As shown in FIG. 2, the cover 32 will rest about one-half inch above the upper surface of the bracket 24. The roller cover portion 34 will typically rest lightly against the sliding gate bar 14 via the recesses 54 in the vertical side wall portions 44. These portions 44 will thus scrape against the bar 14 to ensure that no fingers or clothing enter beneath the cover between the roller 16 and the gate bar 14. Thus the cover 32 is designed simply to loosely rest on the gate bar 14 and the mounting bracket 24. This arrangement effectively protects the roller assembly from weather damage as well as effectively protecting personnel from potential injury.

The roller is preferably made of an ultra high molecular weight (UHMW) polyethylene. This type of polyethylene has superior physical and mechanical strength and wear resistance compared to other polyethylenes. The cover 32 is preferably injection molded as a single body of UHMW or high density polyethylene which has been treated for enhanced UV-A and UV-B resistance.

While the invention has been shown and described with reference to a particular embodiment thereof, it is to be understood that various changes, modifications and alternatives will be readily apparent to those skilled in the art. For example, the overall shape of the roller cover portion and the bracket cover portion may be other than as specifically described. The cover 32 may be made of sheet metal as well as plastic or may wrap around the back side of the post 12 to provide further weather protection. Accordingly, the illustrated preferred embodiment and these and other changes and alternatives are merely illustrative and should not be taken as limitations of the true scope and fair meaning of the invention as is set forth and described by the appended claims.

I claim:

1. In a sliding gate system which includes a horizontally disposed gate having an upper horizontal gate support bar guided by at least one grooved roller rotatably mounted on a stub shaft secured to a vertical support post by a mounting bracket, the improvement comprising a protective cover substantially surrounding said roller, said cover including a roller cover portion having an open bottom and an integral stub shaft and mounting bracket cover portion having an open bottom and a pair of spaced vertical side walls merging with a top portion covering said stub shaft and a substantial portion of said mounting bracket, said stub shaft and bracket cover portion merging with said roller cover portion to form a unitary structure having an open bottom over and around said roller and stub shaft whereby entry of a person's fingers or clothing is prevented and said roller, said stub shaft and said substantial portion of said mounting bracket are substantially protected from rain and snow.

2. The improvement according to claim 1, wherein said cover further comprises a vertical intermediate wall joining said roller cover portion and said stub shaft and mounting bracket cover portion together, said intermediate wall having an opening therethrough for passage of said stub shaft and a portion of said mounting bracket.

3. The improvement according to claim 1, wherein said cover further comprises said vertical side walls each having an aperture therethrough for receiving an elongated retaining member passing under said mounting bracket and through said apertures to releasably secure said cover in place.

4. The improvement according to claim 2, wherein said bracket cover portion has a flat top wall and said space between said vertical side walls is less than the diameter of said roller.

5. The improvement according to claim 4, wherein said top wall has a recess in a back edge thereof for receiving said support post therein.

6. The improvement according to claim 1, wherein said roller is composed of an ultra high molecular weight polyethylene material.

7. A cover for a gate roller assembly which includes a grooved roller rotatably supported on a stub shaft, said shaft being fixed in a mounting bracket which is clamped to a vertical gate support post, said cover comprising:

a roller cover portion having a peripheral wall receiving said roller thereunder and a vertical end wall covering an end face of said roller; and a mounting bracket cover portion having a pair of spaced vertical side walls and a generally horizontal top wall joining said side walls, and an intermediate wall joining said side walls and top wall with said peripheral wall of said roller cover portion so that said cover is of a unitary construction.

8. The cover according to claim 7, wherein said cover further comprises said vertical side walls each having an aperture therethrough for receiving a wire-like fastener passing under said mounting bracket and through said apertures to secure said cover in place.

9. The cover according to claim 8, wherein said bracket cover portion has a first top wall and said space between said vertical side walls is less than the diameter of said roller.

10. The cover according to claim 9, wherein said top wall has a recess in a back edge thereof for receiving said support post therein.

11. The cover according to claim 10, wherein said cover is made of plastic.

12. The cover according to claim 7, wherein said roller is composed of an ultra high molecular weight polyethylene material.

* * * * *